US005429295A

United States Patent [19]

Levy

[11] Patent Number: 5,429,295

[45] Date of Patent: Jul. 4, 1995

[54] LIDDED BOX AND PRE-CUT CARDBOARD BLANK FOR SAME

[76] Inventor: Abner Levy, 325 N. Oakhurst Dr., P4, Beverly Hills, Calif. 90210

[21] Appl. No.: 168,646

[22] Filed: Dec. 16, 1993

[51] Int. Cl.[6] ..... B65D 5/22; B65D 43/16

[52] U.S. Cl. ..... 229/130; 229/152; 229/153

[58] Field of Search ..... 229/130, 152, 153, 178, 229/194

[56] References Cited

U.S. PATENT DOCUMENTS

| | | | |
|---|---|---|---|
| 1,269,621 | 6/1918 | Lewinson | 229/152 |
| 1,871,706 | 8/1932 | Krebs | 229/152 |
| 1,940,183 | 12/1933 | Petersen | 229/152 |
| 2,089,509 | 8/1937 | Taylor | 229/152 |
| 2,110,644 | 11/1937 | Groves | 229/152 |
| 2,447,563 | 8/1948 | Buttery | 229/153 |
| 2,663,488 | 12/1953 | Gibbons | 229/152 |
| 2,774,529 | 12/1956 | Abrams et al. | 229/152 |
| 3,203,617 | 8/1965 | Paige | 229/152 |
| 3,385,424 | 5/1968 | Thompson et al. | 229/178 |
| 3,987,957 | 10/1976 | Johnson | 229/152 |
| 4,488,675 | 12/1984 | von Gnechten et al. | 229/153 |
| 4,572,423 | 2/1986 | Spencer | 229/178 |
| 5,236,122 | 8/1993 | Ballard | 229/153 |

FOREIGN PATENT DOCUMENTS

| | | | |
|---|---|---|---|
| 93779 | 9/1962 | Denmark | 229/152 |
| 961699 | 5/1950 | France | 229/152 |
| 62959 | 10/1940 | Norway | 229/152 |

*Primary Examiner*—Gary E. Elkins
*Attorney, Agent, or Firm*—Beehler & Pavitt

[57] ABSTRACT

A cardboard box with a bottom, four sides panels and a lid hinged to one side panels, the lid having opposite side edges and side flaps attached to the side edges. The side flaps make selective frictional contact with a front panel of the box to provide a tactile indication before the side flaps spread apart upon full withdrawal from the box interior when the lid is fully opened, and to help retain the lid in a closed condition. The side flaps do not engage the front panel when the lid lies at intermediate positions between the nearly open position and the closed condition.

17 Claims, 3 Drawing Sheets

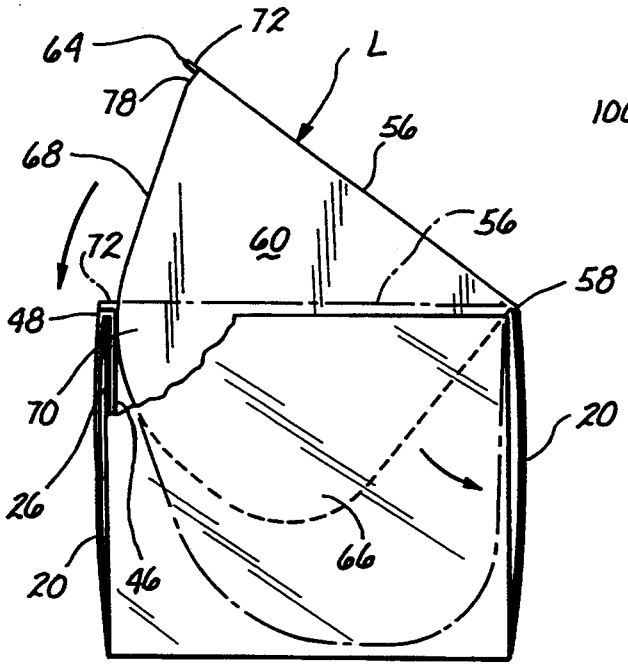
Fig. 6
Fig. 7
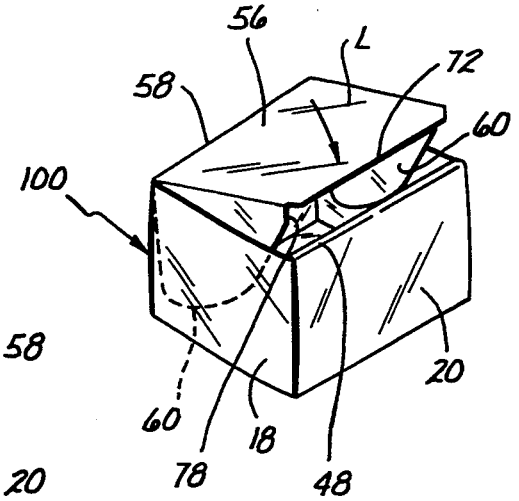

LIDDED BOX AND PRE-CUT CARDBOARD BLANK FOR SAME

BACKGROUND OF THE INVENTION

1. Field of the Invention

The present invention is directed to a cardboard box with integral hinged lid constructed by folding a one-piece blank cut from sheet stock.

2. State of the Prior Art

Many designs exist for cardboard boxes which are formed by folding a pre-cut blank cut from sheet stock such as corrugated cardboard. In particular, cardboard boxes with an integral lid hinged to the box along a fold line are well known. However, presently known lidded boxes require a flap along the front edge of the lid as well as side flaps along each side edge of the lid in order to properly position and support the lid to the box in its closed position. The flaps often make more difficult the closing of the lid because the flaps tend to spread out over the upper edges of the box and prevent the lid from lowering to its closed position. The user must therefore exercise care by pressing the flaps inwardly so that all the flaps are tucked into the box as the lid is pressed down. This maneuver may require a fair degree of manual dexterity as all three flaps may have to be held in place while simultaneously lowering the lid.

A continuing need exists for lidded boxes constructed from a one-piece pre-cut sheet blank which do not inconvenience the user in the aforedescribed manner, yet are sturdy and easy to assemble from the pre-cut blank.

SUMMARY OF THE INVENTION

This invention addresses the aforementioned need by providing a pre-cut blank for making a box which has an integral lid hinged along a fold line characterized in that the lid has no flap along its front edge, and has self-aligning side flaps which are readily tucked into the box under the lid. The pre-cut blank of this invention is divided by fold lines into a central base panel having fold lines along four sides, a pair of side panels joined to one opposite pair of said four sides, first and second inner panels joined to opposite edges of each side panel, a pair of end panels joined to another opposite pair of the four sides of the central base panel, a third inner panel joined to one of the end panels by means of a spacer strip defined between parallel fold lines, and a top panel joined to the other of the two end panels.

One or both inner panels on each of the side panels may have interlocking portions for securing the inner panels and the side panels in an upright assembled position on the base panel in a first intermediate step of assembly of the blank into a box.

The third inner panel may include a retaining element cooperating with the base panel for securing the third inner panel and the end panel to which the third inner panel is attached in upright assembled position on the base panel in a second intermediate stage of assembly of the blank.

The top panel has a pair of side flaps extending from opposite side edges of the top panel for holding the top panel in alignment with the sides of the box and serving as frictional retaining elements for retaining the lid in closing relationship with the box. The side flaps are sized and shaped so that the lid may be sufficiently lifted to an open position to provide convenient access to the interior of the box without having to lift the flap ends fully from the box, thereby preventing the flaps from spreading apart so that the lid can be closed easily by simply pressing down upon it, without concern for positioning of the flaps.

BRIEF DESCRIPTION OF THE DRAWINGS

FIG. 6 is a side elevational view of the assembled box with the lid partially open and the side flaps shown in phantom lining in said partially open position and also in a position corresponding to a fully closed position of the lid; and FIG. 7 is a front side perspective view of the assembled box with the lid partially open.

DETAILED DESCRIPTION OF THE PREFERRED EMBODIMENTS

Figure 1:
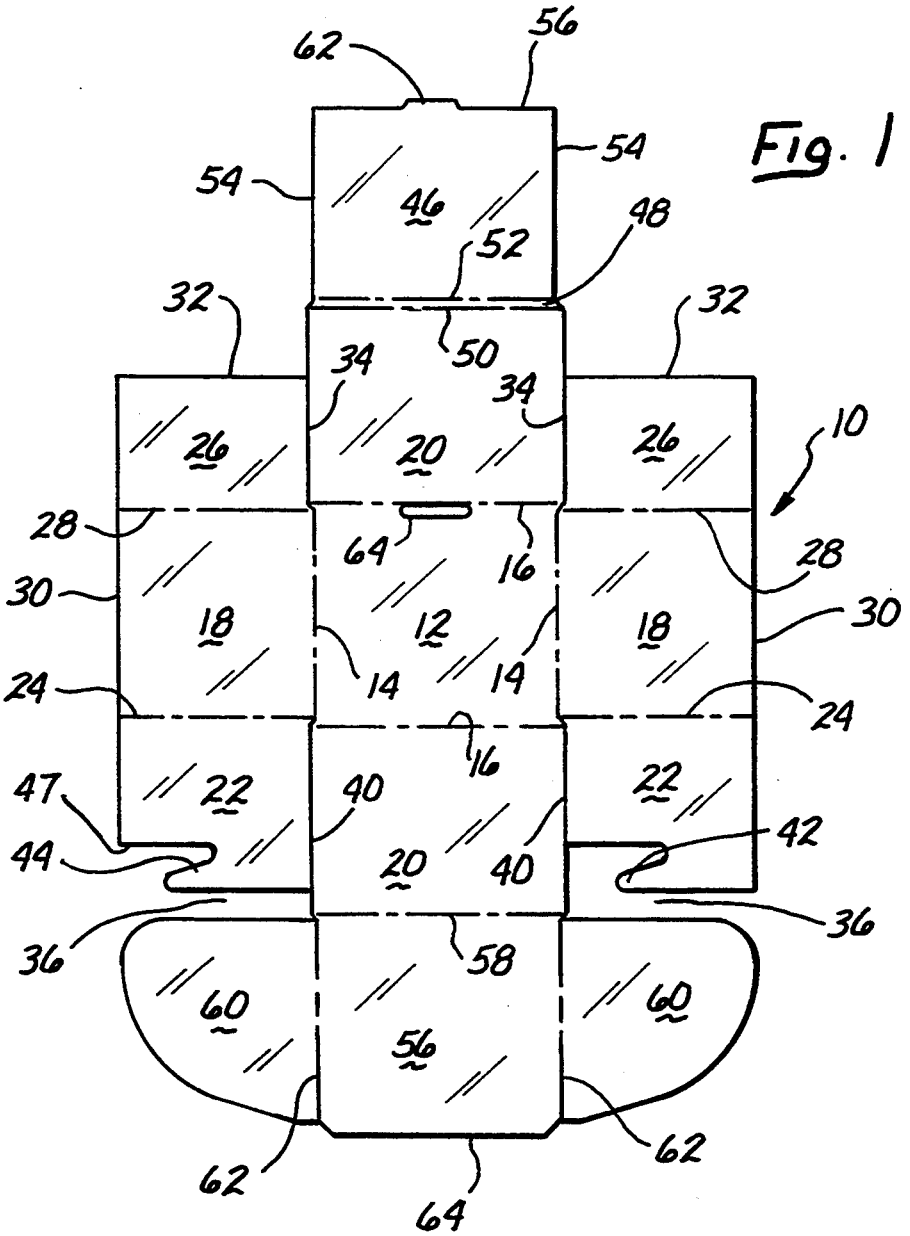
FIG. 1 is a plan view of the pre-cut blank of sheet stock in an initial flat condition.

With reference to the drawings, FIG. 1 shows a pre-cut blank of corrugated cardboard sheet stock, generally designated by the numeral 10. The blank 10 is divided into various panels by cuts and by fold lines or creases pressed into the initially flat sheet stock to facilitate folding of the various panels into a three dimensional box structure. The blank 10 has a rectangular central base panel 12 with one pair of opposite fold lines 14 and a second pair of opposite fold lines 16. A side panel 18 is joined to the base panel 12 along each fold line 14, and an end panel 20 is joined to the base panel 12 along each fold line 16. Each side panel 18 has a first inner panel 22 attached along a fold line 24, and a second inner panel 26 attached along a fold line 28, the fold lines 24, 28 being on opposite sides of the side panels 18 and perpendicular to the fold lines 14. The side panels 18 each have a free edge 30 which is also common to the first and second inner panels 22, 26 respectively of each side panel 18. The second inner panels 26 are each bounded by a free edge 32 and a cut 34. The first inner panels are bounded by the fold line 24, free edge 30, a free edge 36 and a cut 40. The inner panels 22 have a finger shaped latch element 42, 44 respectively, shaped to interlock with each other as will be explained below.

A third inner panel 46 is joined to one end panel 20 by means of a spacer strip 48 which is defined between two closely spaced parallel fold lines 50 and 52. The third inner panel 46 is further defined by a free edge 56 intermediate two opposite free side edges 54. A top panel 56 is joined to the other end panel 20 along a fold line 58. Two side flaps 60 are joined to opposite sides of the top panel 56 along the opposite fold lines 62. A free edge 64 of the top panel 56 extends between the side flaps 60.

Figure 5:
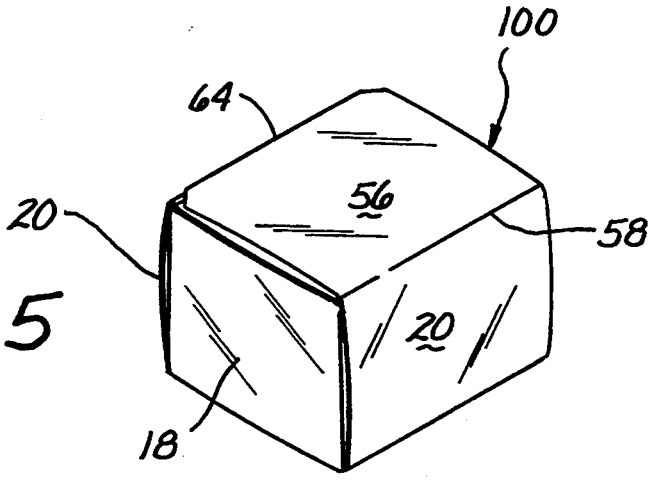
FIG. 5 shows the box in fully assembled condition with the top panel folded to a closed condition.

Assembly of the pre-cut blank into a lidded rectangular box 100 shown in FIG. 5 will now be described as a sequence of three stages illustrated in FIGS. 2 through 4 of the drawings.

Figure 2:
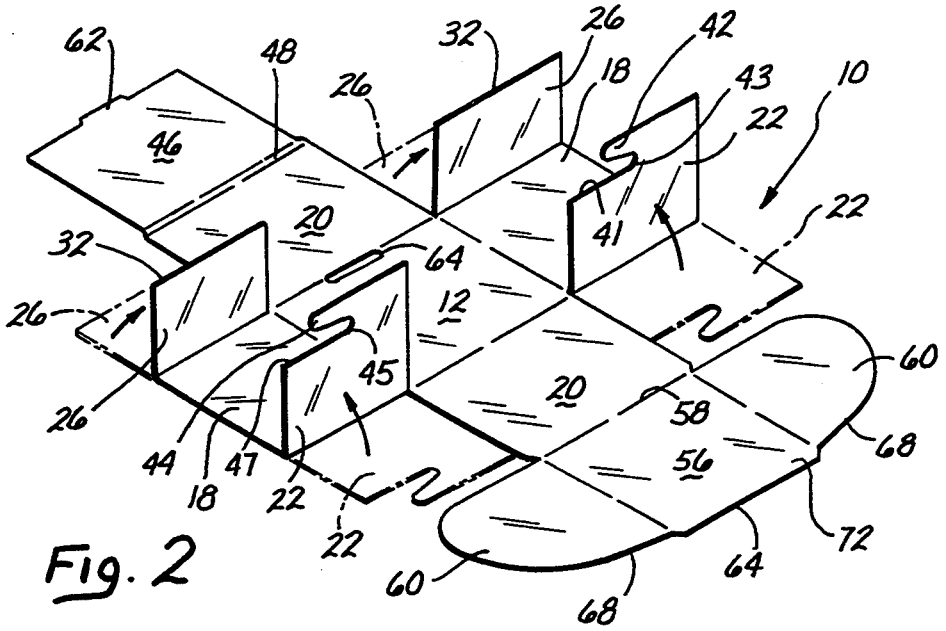
FIG. 2 is a perspective view showing the blank of FIG. 1 in an first stage of assembly with the first and second inner panels folded to an upright condition in relation to the side panels to which they are attached.
Figure 3:
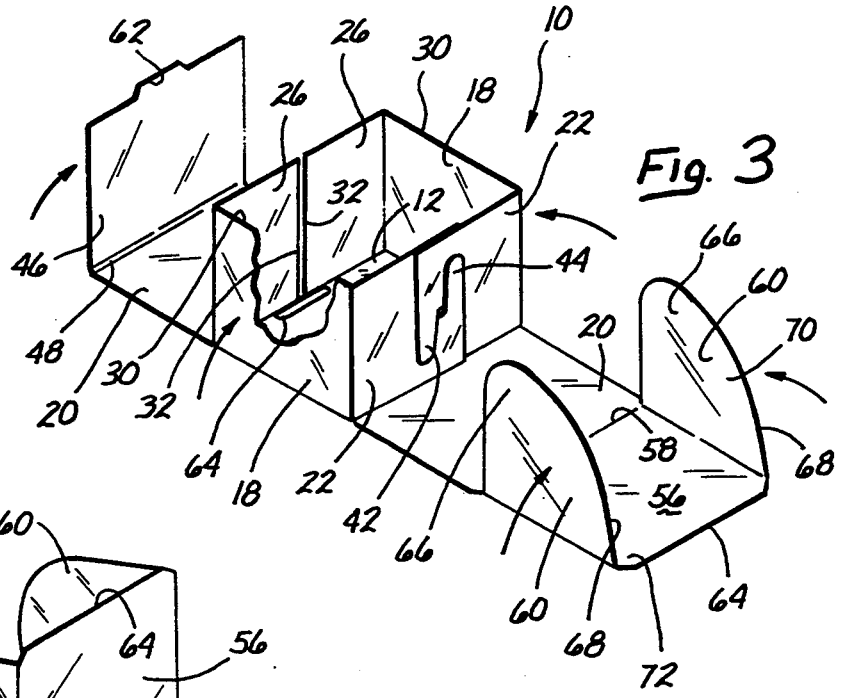
FIG. 3 is a perspective view showing the blank of FIG. 1 in a second stage of assembly wherein the side panels have been folded to an upright condition relative to the center base panel and are retained in upright position by interlocking of one pair of inner panels attached to the side panels. In addition, the third end panel is shown folded to an upright condition relative to its adjoining end panel, and the side flaps of the top panel have also been folded to an upright position.

Folding of the blank 10 from its initial flat condition of FIG. 1 begins by folding the first and second inner panels 22, 26 to an upright position perpendicular to their corresponding side panels 18, by lifting each inner panel 22, 26 from the phantom lined position to the solid lined position in FIG. 2. The side panels 18 are then folded along their respective fold lines 14 to an upright position perpendicular to the base panel 12, bringing the inner panels 26, 22 on each side panel towards each other to form a rectangular box as shown in FIG. 3, in which side panels 18 and inner panels 22, 26 are all perpendicular to the base panel 12. One pair of inner panels 22 are interlocked to each other by engagement of the latch elements 42, 44. The latch element 44 extends upwardly when its corresponding inner panel 22 is brought upright on the base panel 12, while latch element 42 extends downwardly when its corresponding inner panel 22 is brought to a similar upright position on the base panel 12. The width of the inner panels 22 measured between fold line 24 and the free edge 36 of each panel is such that the latch elements overlap, and latch element 42 engages within a notch 45 defined between the latch element 44 and an edge segment 47 of the opposite inner panel 22, while the latch element 44 engages within a notch 43 defined between latch element 42 and edge segment 41 of the corresponding inner panel 22. The latch elements 42, 44 interlock in this manner, as illustrated in FIG. 3, to hold the four inner panels 22, 26 and side panels 18 in upright position relative to the base panel 12. The pair of second inner panels 26 do not interlock with each other, and only have their free edges 32 in closely opposing, mutually parallel relationship. It should be appreciated that the width of the side panels 18 measured between the fold lines 24 and 28 is slightly lesser than the width of the base panel 12 measured between the opposite fold lines 16. This difference in panel width is so that the full thickness of the corrugated cardboard stock of the inner panels 22, 26 is contained between the fold lines 16 in the upright position of the inner panels shown in FIG. 3. This is so that the thickness of the inner panels does not obstruct the subsequent folding of the end panels 20 along the fold lines 16 to an upright position, as shown in FIG. 4.

The third inner panel 46 and the spacer strip 48 are folded relative to their adjacent end panel 20, the latter is folded along its fold line 16 to an upright position against the inner panels 32. The spacer strip 48 lies over the upper edges 30 of the inner panels 26, while the third inner panel 46 is folded down against the inner side of the panels 26. In other words, the panel 20, strip 48 and panel 46 form an inverted U when seen edgewise. The two inner panels 26 are sandwiched or contained between the end panel 20 and the third inner panel 46, with the strip 48 at the top over the upper edges of the inner panels 26. This arrangement is secured by a tab 62 on the free edge 56 of panel 46, which tab is pressed into an aligned slot 64 in the base panel 12, making a close retentive fit therein.

Figure 4:
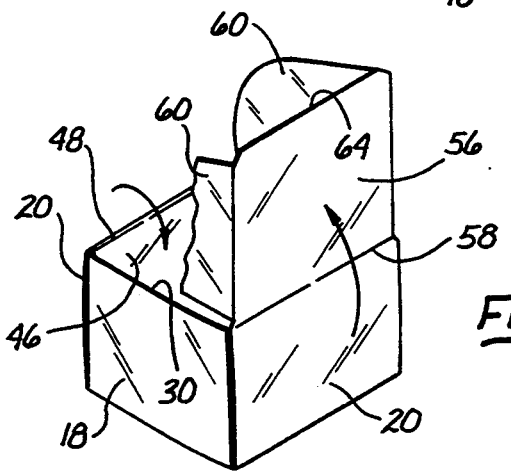
FIG. 4 is a perspective view showing the blank of FIG. 1 in a third stage of assembly wherein the third inner panel and its adjoining end panel have been folded over the non-interlocked inner panels and the second end panel is folded upright against the interlocked inner panels.

The side flaps 60 are then folded to a mutually parallel position perpendicular to the top panel 56, and the end panel 20 attached to the top panel 56 is folded along fold line 16 to an upright condition against the interlocked inner panels 22, to a stage of assembly illustrated in FIG. 4. At this stage the box is fully assembled with the top panel 56, which functions as the lid of the box, still open. Assembly is completed by pressing the side flaps 60 lightly towards each other to clear the upper side edges 30 of the box, and folding the top panel 56 along fold line 58 together with side flaps 60 to a closed position shown in FIG. 5, where the side flaps 60 hang from the top panel 56 into the interior of the box in contact with the side panels 18. The top panel 56 and side flaps 60 make up the lid L of the assembled box 100, which lid is integral with and-hinged to the box along fold line 58. Contact of the side flaps 60 with the side panels 18 positions and stabilizes the top panel 56 in square alignment with the four sides of the box, and also serves as a frictional retainer for holding the top panel 56 in the closed position of FIG. 5.

It will be appreciated that the resulting box 10 is of rugged construction without use of adhesives or fastener devices. The front side of the box is of triple cardboard thickness, consisting of panels 20, 32 and 46 laid one over the other. The rear side of the box is of better than double cardboard thickness, made up of partially overlapping panels 22 and panel 20. The box side panels 18 are positively held upright and square with the front, back and base panel by this interlocking assembly of multiple thickness cardboard.

The side flaps 60 are of sufficient size and shape that at least the rear corner 66 of each side flap remain below the upper edge 30 of the adjacent side panel 18 in a substantially open position of the top panel 56, such as illustrated in solid lining in FIG. 6, and which is sufficient to permit convenient access into the box 100, so as to prevent the free ends of side panels from spreading apart outside the box with the lid L open. The forward edge 68 of each side panel is conexly curved and recedes from the front edge 64 of the top panel 56 to clear the top edge of the front side of the box as the lid moves between its open and closed positions. The front lower corner 70 of each side panel makes sliding contact with the third inner panel 46 near the strip 48 with a degree of friction sufficient to serve as an indication to a person opening the box of sufficient aperture of the lid L, to avoid opening the top panel 56 to a point at which the side flaps 60 would be fully withdrawn from the box and raised over the side edges 30, from where the flaps might have to be manually tucked into the box before the lid L could be again closed.

The top panel 56 has a front lip 72 which projects beyond the forward edges 68 of the side flaps 60 to front edge 64, and rests upon the strip 48 in the closed position of the lid L indicated in phantom lining in FIG. 6, as a stop to keep the top panel 56 from being pressed into the box. The front edges of the side flaps 60 include portions 78 which press against the third inner panel 46 when the lid is closed, as a further retainer helping to keep the lid closed.

When fully assembled, the box 10o is sturdy and resistant to deformation and crushing, yet is easy to assemble from the unitary sheet stock blank 10 of FIG. 1.

As seen in FIG. 6, the front edges 68 of the side flaps are shaped such that there is no engagement between the side flaps and the front side of the box, i.e. with the inner panel 46, at partially open positions of the lid L intermediate the phantom lined fully closed position and the solid lined sufficiently open position at which the corner portions 70 of the side flaps make frictional contact with the inner panel 46.

While certain preferred embodiments of the invention have been described and illustrated for purposes of clarity and example, it must be understood that many changes, substitutions, and modifications to the described embodiments will become obvious to those possessed of ordinary skill in the art without their thereby departing from the scope and spirit of the present invention which is defined by the following claims.

What is claimed is:

1. A box assembled by folding a unitary sheet divided by fold lines into a plurality of panels, said box including a bottom, four sides each having an upper edge and a lid hinged to one said upper edge, said lid having a front lip supported on one of said upper edges in a closed condition of said lid to prevent depression of said lid below said upper edges wherein said lid has opposite side edges and side flaps attached to said side edges, said side flaps have front edges curved to engage in frictional sliding contact with one of said sides in a substantially open condition of said lid thereby to serve as an indication prior to full withdrawal of said side flaps from between said sides.

2. The box of claim 11 wherein said side flaps do not engage in said frictional sliding contact between said substantially open condition and said closed condition of said lid.

3. The box of claim 1 wherein said side flaps have first front edge portions engageable to one of said sides in said closed condition of said lid thereby to aid in retaining said lid in said closed condition.

4. The box of claim 3 wherein said side flaps have second front edge portions engageable in frictional sliding contact with said one of said sides in a substantially open condition of said lid thereby to serve as an indication prior to full withdrawal of said side flaps from between said sides.

5. The box of claim 4 wherein said side flaps do not engage in said frictional sliding contact with said one of said sides between said substantially open condition and said closed condition of said lid.

6. A box assembled by folding a unitary sheet divided by fold lines into a plurality of panels, said box including a bottom, four sides each having an upper edge and a lid hinged to one said upper edge, one of said sides comprised of first and second of said panels joined by a relatively narrow strip at another said upper edge, said lid having a front lip supported on said narrow strip in a closed condition of said lid to prevent depression of said lid below said upper edges;

wherein said lid has opposite side edges and side flaps attached to said side edges, said side flaps have first front edge portions shaped to engage in frictional sliding contact with one of said sides in a substantially open condition of said lid thereby to serve as an indication prior to full withdrawal of said side flaps from between said sides.

7. The box of claim 6 wherein said side flaps do not engage in said frictional sliding contact between said substantially open condition and said closed condition of said lid.

8. The box of claim 6 wherein said side flaps have second front edge portions engageable to one of said sides in said closed condition of said lid thereby to aid in retaining said lid in said closed condition.

9. The box of claim 8 wherein said side flaps do not engage in said frictional sliding contact with said one of said sides between said substantially open condition and said closed condition of said lid.

10. A box assembled by folding a unitary sheet divided by fold lines into a plurality of panels, said box including a bottom, four sides each having an upper edge and a lid hinged to one said upper edge, said lid having opposite side edges and side flaps attached to said side edges, said side flaps having front edges curved to engage in frictional sliding contact with one of said sides in a substantially open condition of said lid thereby to serve as an indication prior to full withdrawal of said side flaps from between said sides, there being no said frictional sliding contact between said substantially open condition and a closed condition of said lid.

11. The box of claim 10 wherein said side flaps have front edge portions engageable to said one of said sides in said closed condition of said lid thereby to aid in retaining said lid in said closed condition.

12. A box assembled by folding a unitary sheet divided by fold lines into a plurality of panels, said box including a bottom, four sides each having an upper edge and a lid hinged to one said upper edge, one of said sides comprised of two of said panels joined by a relatively narrow strip at another said upper edge, said lid having a front lip supported on said narrow strip in a closed condition of said lid to prevent depression of said lid below said upper edges, said lid having opposite side edges and side flaps attached to said side edges, said side flaps having first front edge portions shaped to engage in frictional sliding contact with said one of said sides in a substantially open condition of said lid thereby to serve as an indication prior to full withdrawal of said side flaps from between said sides, second front edge portions on said side flaps engageable to said one of said sides in said closed condition of said lid thereby to aid in retaining said lid in said closed condition, there being no engagement of said side flaps with said one of said sides between said substantially open condition and said closed condition of said lid.

13. The box of claim 12 wherein said bottom is a central base panel having four sides, said four side panels comprise a pair of side panels joined to one pair of opposite sides of said base panel and a pair of end panels joined to another pair of opposite sides of said base panel, and further comprising first and second inner panels joined to opposite edges of each said side panel, said one of said sides being one of said end panels, and a top panel joined to the other of said end panels.

14. The box of claim 13 further comprising interlocking means on at least one of said first and second inner panels for securing said inner panels and said side panels in upright assembled position on said base panel.

15. The box of claim 14 further comprising retaining means on said third inner panel and said base panel for securing said inner panel and said one of said end panel joined to said inner panel in upright assembled position on said base panel.

16. The box of claim 15 further comprising retaining means on said top panel for securing said top panel in closing relationship with said side panels, said end panels and said inner panels in said upright assembled position thereof.

17. The box of claim 16 wherein said retaining means on said top panel comprise side flaps, each of said flaps attached to said top panel along a respective fold line.

* * * * *